US009076442B2

(12) United States Patent
Jeon et al.

(10) Patent No.: US 9,076,442 B2
(45) Date of Patent: Jul. 7, 2015

(54) METHOD AND APPARATUS FOR ENCODING A SPEECH SIGNAL

(75) Inventors: Hyejeong Jeon, Seoul (KR); Daehwan Kim, Seoul (KR); Gyuhyeok Jeong, Seoul (KR); Minki Lee, Seoul (KR); Honggoo Kang, Seoul (KR); Byungsuk Lee, Seoul (KR); Lagyoung Kim, Seoul (KR)

(73) Assignees: LG Electronics Inc., Seoul (KR); Industry-Academic Cooperation Foundation, Yonsei University, Seoul (KR)

( * ) Notice: Subject to any disclaimer, the term of this patent is extended or adjusted under 35 U.S.C. 154(b) by 237 days.

(21) Appl. No.: 13/514,613

(22) PCT Filed: Dec. 10, 2010

(86) PCT No.: PCT/KR2010/008848

§ 371 (c)(1),
(2), (4) Date: Jun. 8, 2012

(87) PCT Pub. No.: WO2011/071335

PCT Pub. Date: Jun. 16, 2011

(65) Prior Publication Data

US 2012/0245930 A1 Sep. 27, 2012

Related U.S. Application Data

(60) Provisional application No. 61/285,184, filed on Dec. 10, 2009, provisional application No. 61/295,165, filed on Jan. 15, 2010, provisional application No. 61/321,883, filed on Apr. 8, 2010, provisional application No. 61/348,225, filed on May 25, 2010.

(51) Int. Cl.
*G10L 19/00* (2013.01)
*G10L 19/07* (2013.01)

(52) U.S. Cl.
CPC ..... *G10L 19/07* (2013.01); *G10L 2019/0013* (2013.01); *G10L 2019/0007* (2013.01); *G10L 2019/0016* (2013.01); *G10L 2019/001* (2013.01)

(58) Field of Classification Search
CPC ..... G10L 19/04; G10L 19/07
USPC ..... 704/219, 222
See application file for complete search history.

(56) References Cited

U.S. PATENT DOCUMENTS 6,108,624 A 8/2000 Park
6,574,593 B1 * 6/2003 Gao et al. ..... 704/222

(Continued)

FOREIGN PATENT DOCUMENTS

CN 1235335 A 11/1999
CN 1975861 A 6/2007

(Continued)

OTHER PUBLICATIONS

European Search Report dated Jul. 19, 2013 for Application No. 10 836 230.2, 8 pages.

(Continued)

*Primary Examiner* — Jakieda Jackson
(74) *Attorney, Agent, or Firm* — Fish & Richardson P.C.

(57) ABSTRACT

According to the present invention, a linear prediction filter coefficient of a current frame is acquired from an input signal using linear prediction, a quantized spectrum candidate vector of the current frame, corresponding to the linear prediction filter coefficient of the current frame, is acquired on the basis of first best information, and the quantized spectrum candidate vector of the current frame and the quantized spectrum vector of the previous frame are interpolated. Accordingly, in contrast to conventional phased optimization techniques, optimum parameters which minimize quantization errors, can be obtained.

10 Claims, 7 Drawing Sheets

(56) References Cited

U.S. PATENT DOCUMENTS

| | | | | |
|---|---|---|---|---|
| 7,389,227 | B2 | 6/2008 | Kang et al. | |
| 2001/0010038 | A1 | 7/2001 | Kang et al. | |
| 2003/0014249 | A1 | 1/2003 | Ramo | |
| 2008/0294429 | A1 * | 11/2008 | Su et al. | 704/222 |
| 2010/0057446 | A1 | 3/2010 | Morii | |

FOREIGN PATENT DOCUMENTS

| | | | |
|---|---|---|---|
| EP | 0 902 421 | A2 | 3/1999 |
| EP | 2128858 | A1 | 12/2009 |
| KR | 10-1996-0015861 | B1 | 11/1996 |
| KR | 10-2001-0084468 | A | 9/2001 |
| KR | 10-2009-0117877 | A | 11/2009 |
| WO | WO 02/093551 | A2 | 11/2002 |
| WO | WO 2008108076 | A1 | 9/2008 |

OTHER PUBLICATIONS

Rapporteur Q9/16: "Updated draft new of new ITU-T Recommendation G.VBR-EV", ITU-T SG16 Meeting; Apr. 22-May 2, 2008; Geneva,, No. T05-SG16-080422-TD-WP3-0338, Apr. 24, 2008, XP030100513, pp. 2, 30-35, and 60-72.

"Frame error robust narrow-band and wideband embedded variable bit-rate coding of speech and audio from 8-32 kbit/s"; Recommendation ITU-T G.718; Study Period 2009-2012, International Telecommunication Union, Geneva ; CH, vol. Study Group 16, Sep. 13, 2010, pp. 1-257, XP017452920, [Retrieved on Sep. 13, 2010]; pp. i-ii, 21-26, and 52-70.

International Search Report dated Aug. 18, 2011 for Application No. PCT/KR2010/008848, with English translation, 4 pages.

* cited by examiner

METHOD AND APPARATUS FOR ENCODING A SPEECH SIGNAL

CROSS REFERENCE TO RELATED APPLICATIONS

This application is a U.S. National Phase Application under 35 U.S.C. §371 of International Application PCT/KR2010/008848, filed on Dec. 10, 2010, which claims the benefit of U.S. Provisional Application No. 61/285,184, filed on Dec. 10, 2009, U.S. Provisional Application No. 61/295,165, filed on Jan. 15, 2010, U.S. Provisional Application No. 61/321,883, filed on Apr. 8, 2010, and U.S. Provisional Application No. 61/348,225, filed on May 25, 2010, the entire contents of the prior applications are hereby incorporated by reference in their entireties.

TECHNICAL FIELD

The present invention relates to a method and apparatus for encoding a speech signal.

BACKGROUND ART

In order to increase compressibility of a speech signal, linear prediction, an adaptive codebook and a fixed codebook search technique may be used.

DISCLOSURE

Technical Problem

An object of the present invention is to minimize spectrum quantization error in encoding a speech signal.

Technical Solution

The object of the present invention can be achieved by providing a method of encoding a speech signal including extracting candidates which may be used as an optimal spectrum vector with respect to a speech signal according to first best information.

In another aspect of the present invention, there is provided a method of encoding a speech signal including extracting candidates which may be used as an optimal adaptive codebook with respect to a speech signal according to second best information.

In another aspect of the present invention, there is provided a method of encoding a speech signal including extracting candidates which may be used as an optimal fixed codebook with respect to a speech signal according to third best information.

Advantageous Effects

According to the embodiments of the present invention, a method of encoding a speech signal based on best information is a method of extracting candidates of an optimal coding parameter and determining an optimal coding parameter through a search process of combining all coding parameters. It is possible to obtain an optimal parameter for minimizing quantization error as compared to the step-by-step optimization scheme and to improve quality of a synthesized speech signal. In addition, the present invention is compatible with conventional various speech encoding technologies.

BEST MODE

Figure 1:
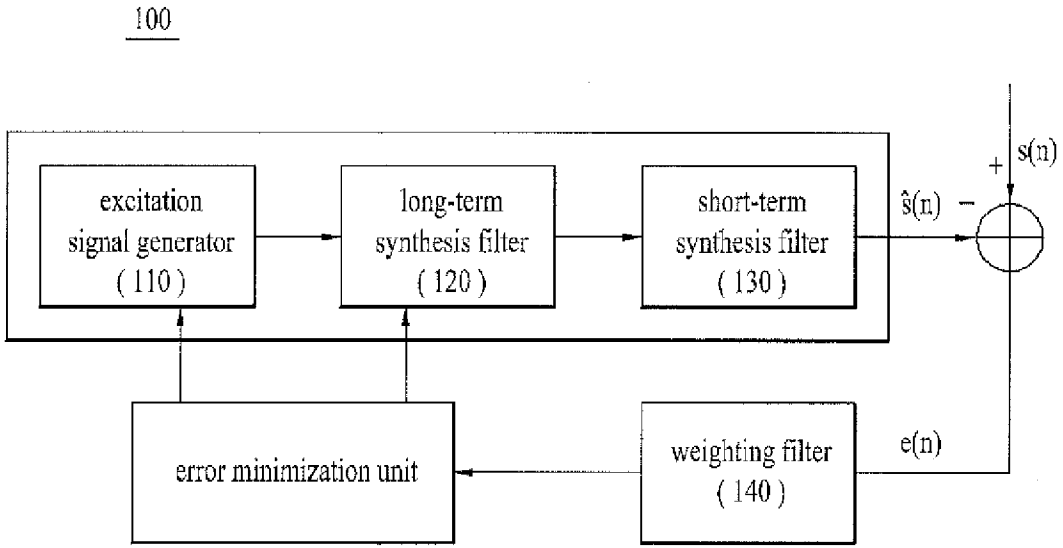
FIG. 1 is a block diagram showing an analysis-by-synthesis type speech encoder.

According to the present invention, there is provided a method of encoding a speech signal, the method including acquiring a linear prediction filter coefficient of a current frame from an input signal using linear prediction, acquiring a quantized spectrum candidate vector of the current frame corresponding to the linear prediction filter coefficient of the current frame based on first best information, and interpolating the quantized spectrum candidate vector of the current frame and a quantized spectrum vector of a previous frame.

The first best information may be information about the number of codebook indexes extracted in frame units.

The acquiring the quantized spectrum candidate vector may include transforming the linear prediction filter coefficient of the current frame into a spectrum vector of the current frame, calculating error between the spectrum vector of the current frame and a codebook of the current frame, and extracting codebook indexes of the current frame in consideration of the error and the first best information.

The method may further include calculating error between the spectrum vector and codebook of the current frame and aligning the quantized code vectors or codebook indexes in ascending order of error.

The codebook indexes of the current frame may be extracted in ascending order of error between the spectrum vector and codebook of the current frame.

The quantized code vectors corresponding to the codebook indexes may be quantized immitance spectrum frequency candidate vectors of the current frame.

According to the present invention, there is provided an apparatus for encoding a speech signal, the apparatus including a linear prediction analyzer 200 configured to acquire a linear prediction filter coefficient of a current frame from an input signal using linear prediction, and a quantization unit 210 configured to acquire a quantized spectrum candidate vector of the current frame corresponding to the linear prediction filter coefficient of the current frame based on first best information and to interpolate the quantized spectrum candidate vector of the current frame and a quantized spectrum vector of a previous frame.

The first best information may be information about the number of codebook indexes extracted in frame units.

The quantization unit 210 configured to acquire the quantized spectrum frequency candidate vector may transform the linear prediction filter coefficient of the current frame into a spectrum vector of the current frame, measure error between the spectrum vector of the current frame and a codebook of the current frame, and extract codebook indexes in consideration of the error and the first best information, and the codebook of the current frame may include quantized code vectors and codebook indexes corresponding to the quantized code vectors.

The quantization unit 210 may calculate error between the spectrum vector and codebook of the current frame and align the quantized code vectors or the codebook indexes in ascending order of error.

The codebook indexes of the current frame may be extracted in ascending order of error between the spectrum vector and codebook of the current frame.

The quantized code vectors corresponding to the codebook indexes may be quantized immitance spectrum frequency candidate vectors of the current frame.

FIG. 1 is a block diagram showing an analysis-by-synthesis type speech encoder.

An analysis-by-synthesis method refers to a method of comparing a signal synthesized via a speech encoder and an original input signal and determining an optimal coding parameter of the speech encoder. That is, mean square error is not measured in an excitation signal generation step, but is measured in a synthesis step, thereby determining the optimal coding parameter. This method may be called a closed-circuit search method.

Referring to FIG. 1, the analysis-by-synthesis speech encoder may include an excitation signal generator 100, a long-term synthesis filter 110 and a short-term synthesis filter 120. In addition, a weighting filter 130 may be further included according to a method of modeling an excitation signal.

The excitation signal generator 100 may obtain a residual signal according to long-term prediction and finally model a component having no correlation into a fixed codebook. In this case, an algebraic codebook which is a method of encoding a pulse position having a fixed size within a subframe may be used. A transfer rate may be changed according to the number of pulses and a codebook memory can be conserved.

The long-term synthesis filter 110 serves to generate long-term correlation, which is physically associated with a pitch excitation signal. The long-term synthesis filter 110 may be implemented using a delay value D and a gain value $g_p$ acquired through long-term prediction or pitch analysis, for example, as shown in Equation 1.

$$\frac{1}{P(z)} = \frac{1}{1 - g_p z^{-D}} \qquad \text{Equation 1}$$

The short-term synthesis filter 120 models short-term correlation within an input signal. The short-term synthesis filter 120 may be implemented using a linear prediction filter coefficient acquired via linear prediction, for example, as shown in Equation 2.

$$\frac{1}{A(z)} = \frac{1}{1 - S(z)} = \frac{1}{1 - \sum_{i=1}^{p} a_i z^{-i}} \qquad \text{Equation 2}$$

In Equation 2, $a_i$ denotes an i-th linear prediction filter coefficient and p denotes filter order. The linear prediction filter coefficient may be acquired in a process of minimizing linear prediction error. A covariance method, an autocorrelation method, a lattice filter, a Levinson-Durbin algorithm, etc. may be used.

The weighting filter 130 may adjust noise according to an energy level of an input signal. For example, the weighting filter may weight noise in a formant of an input signal and lower noise in a signal with relatively low energy. The generally used weighting filter is expressed by Equation 3 and $\gamma_1$=0.94 and $\gamma_2$=0.6 are used in case of an ITU-T G.729 codec.

$$W(z) = \frac{A(z/\gamma_1)}{A(z/\gamma_2)} \qquad \text{Equation 3}$$

The analysis-by-synthesis method may perform closed-circuit search to minimize error between an original input signal s(n) and a synthesis signal ŝ(n) so as to acquire an optimal coding parameter. The coding parameter may include an index of a fixed codebook, a delay value and gain value of an adaptive codebook, and a linear prediction filter coefficient.

The analysis-by-synthesis method may be implemented using various coding methods based on a method of modeling an excitation signal. Hereinafter, a CELP type speech encoder will be described as a method of modeling an excitation signal. However, the present invention is not limited thereto and the same technical spirit is applicable to a multi-pulse excitation method and an Algebraic CELP (ACELP) method.

Figure 2:
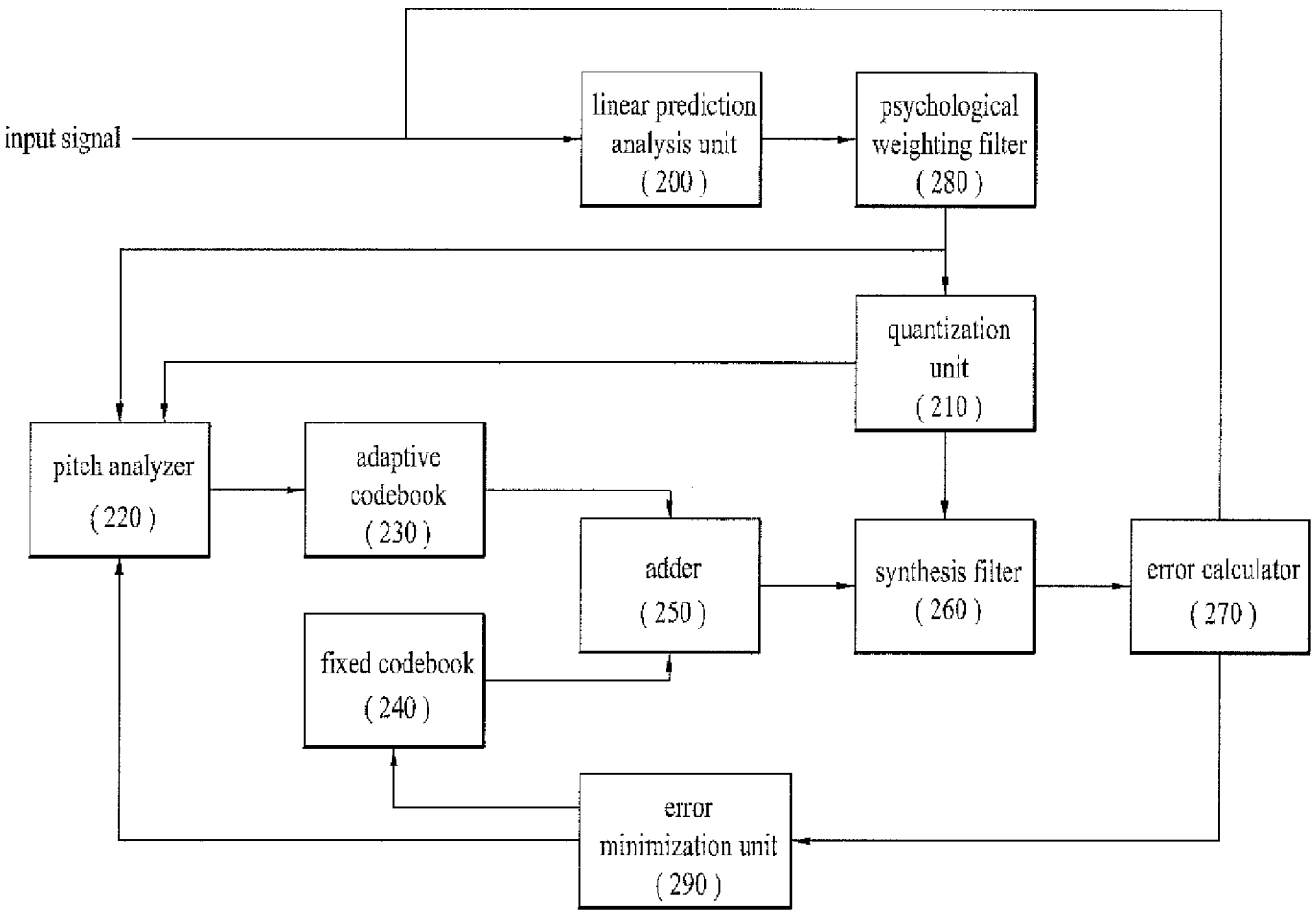
FIG. 2 is a block diagram showing the structure of a code excited linear prediction (CELP) type speech encoder according to an embodiment of the present invention.

FIG. 2 is a block diagram showing the structure of a code excited linear prediction (CELP) type speech encoder according to an embodiment of the present invention.

Referring to FIG. 2, a linear prediction analyzer 200 may perform linear prediction analysis with respect to an input signal so as to obtain a linear prediction filter coefficient. Linear prediction analysis or short-term prediction may determine a synthesis filter coefficient of a CELP model using an autocorrelation approach based on close correlation between a current state and a past state or a future state in time-series data. A quantization unit 210 transforms the obtained linear prediction filter coefficient into an immitance spectral pair which is a parameter suitable for quantization, and quantizes and interpolates the immitance spectral pair. The interpolated immitance spectral pair is transformed onto a linear prediction domain, which may be used to calculate a synthesis filter and a weighting filter for each subframe. Quantization of the linear prediction coefficient will be described with reference to FIGS. 4 and 5. A pitch analyzer 220 calculates a pitch of the input signal. The pitch analyzer obtains a delay value and gain value of a long-term synthesis filter by analyzing the pitch of the input signal subjected to a psychological weighting filter 280, and generates an adaptive codebook therefrom. A fixed codebook 240 may model a random aperiodic signal from which a short-term prediction component and a long-term prediction component are removed and store the random signal in the form of a codebook. An adder 250 multiplies a periodic sound source signal extracted from the adaptive codebook 230 and the random signal output from the fixed codebook 240 by respective gain values according to the estimated pitch, adds the multiplied signals, and generates an excitation signal of a synthesis filter 260. The synthesis filter 260 may perform synthesis filtering by the quantized linear prediction coefficient with respect to the excitation signal output from the adder 250 so as to generate a synthesis signal. An error calculator 270 may calculate error between the original input signal and the synthesis signal. An error minimizing unit 290 may determine a delay value and gain value of an adaptive codebook and a random signal for minimizing error considering listening characteristics through the psychological weighting filter 280.

Figure 3:
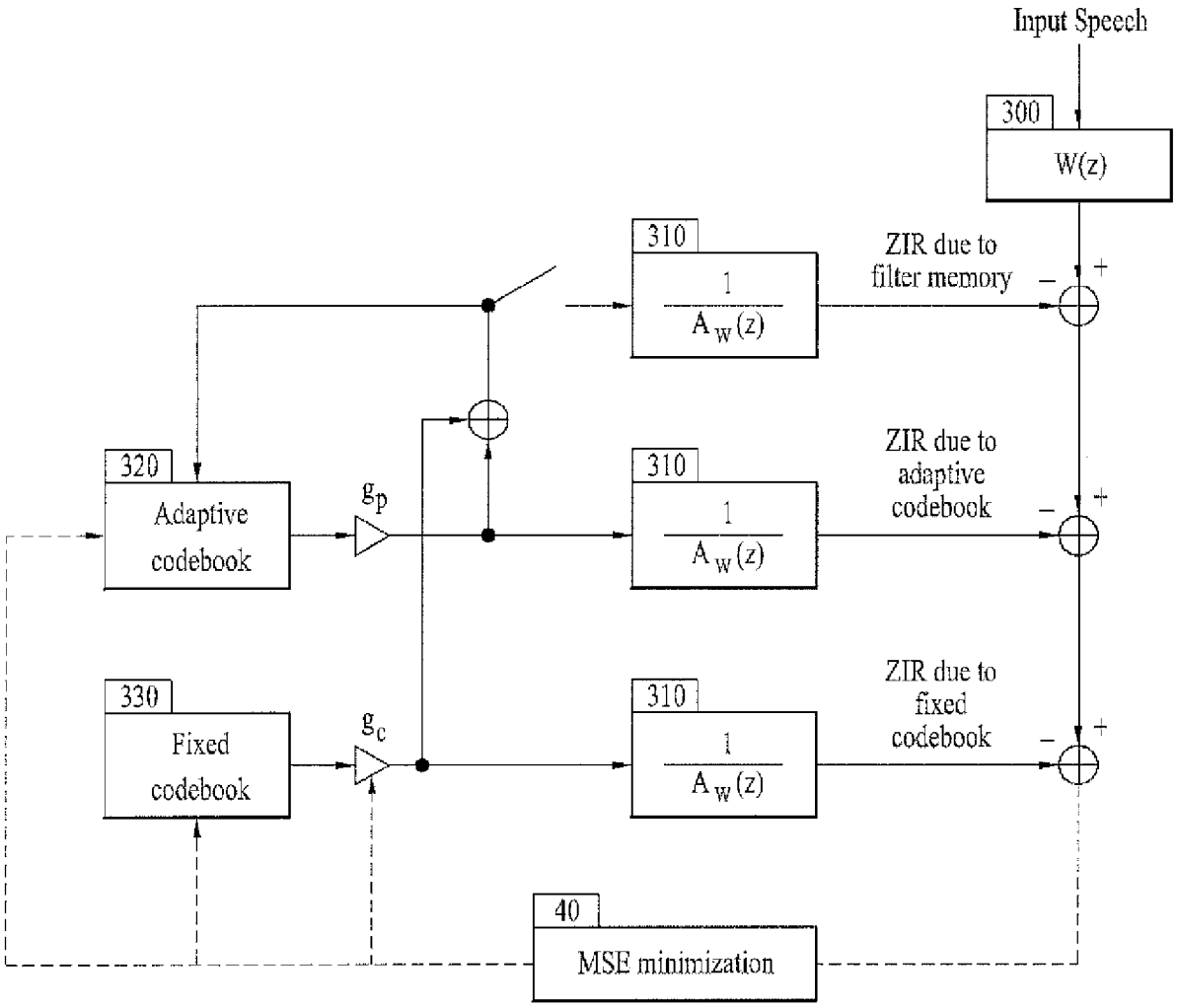
FIG. 3 is a diagram showing a process of sequentially obtaining a coding parameter necessary for a speech signal encoding process according to an embodiment of the present invention.

FIG. 3 is a diagram showing a process of sequentially obtaining a coding parameter necessary for a speech signal encoding process according to an embodiment of the present invention.

Figure 4:
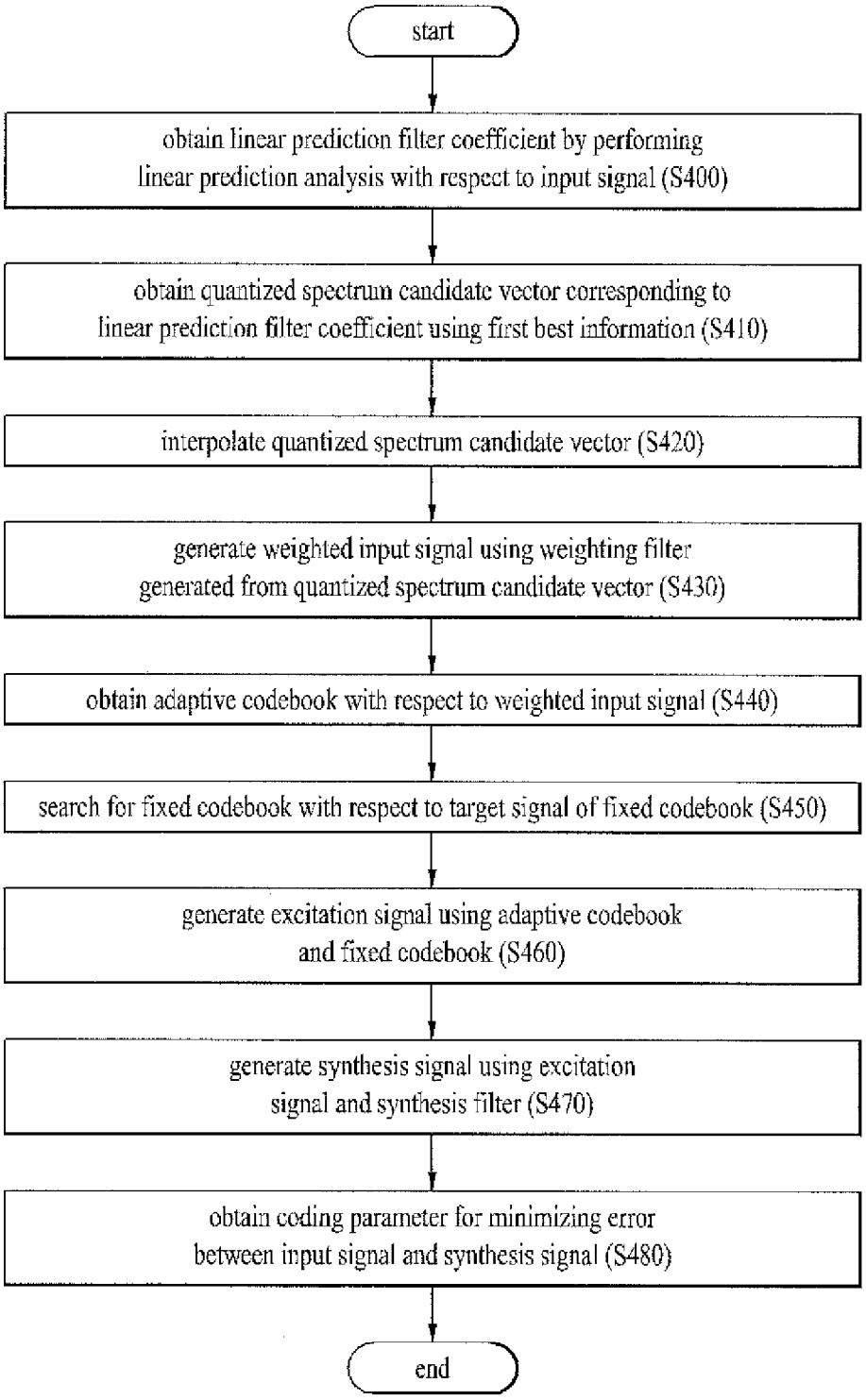
FIG. 4 is a diagram showing a process of quantizing an input signal using a quantized spectrum candidate vector based on first best information according to an embodiment of the present invention.

A speech encoder divides an excitation signal into an adaptive codebook and a fixed codebook and analyzes the codebooks in order to model the excitation signal corresponding to a residual signal of linear prediction analysis. Modeling may be performed as shown in FIG. 4.

$$u(n)=\hat{g}_p v(n)+\hat{g}_c \hat{c}(n), \text{ for } n=0, \ldots, N_s-1 \qquad \text{equation 4}$$

The excitation signal u(n) may be expressed by an adaptive codebook v(n), an adaptive codebook gain value $\hat{g}_p$, a fixed codebook $\hat{c}(n)$ and a fixed codebook gain value $\hat{g}_c$.

Referring to FIG. 3, the weighting filter 300 may generate a weighted input signal from an input signal. First, in order to remove initial memory influence of a weighting synthesis filter 310, a zero input response (ZIR) may be removed from the weighted input signal so as to generate a target signal of an adaptive codebook. The weighting synthesis filter 310 may be generated by applying the weighting filter 300 to a short-term synthesis filter. For example, a weighting synthesis filter used for an ITU-T G.729 codec is shown in Equation 5.

$$\frac{1}{A_w(z)} = \frac{W(z)}{A(z)} = \frac{1}{A(z)}\frac{A(z/\gamma_1)}{A(z/\gamma_2)} \qquad \text{Equation 5}$$

Next, a delay value and gain value of an adaptive codebook corresponding to a pitch may be obtained by a process of minimizing the mean square error (MSE) of a zero state response (ZSR) of the weighting synthesis filter 310 by an adaptive codebook 320 and the target signal of the adaptive codebook. The adaptive codebook 320 may be generated by a long-term synthesis filter 120. The long-term synthesis filter may use an optimal delay value and gain value for minimizing error between a signal passing through the long-term synthesis filter and the target signal of the adaptive codebook. For example, the optimal delay value may be obtained as shown in Equation 6.

$$D = \underset{k}{\operatorname{argmax}}\left\{\frac{\sum_{n=0}^{L-1} u(n)u(n-k)}{\sqrt{\sum_{n=0}^{L-1} u(n-k)u(n-k)}}\right\} \qquad \text{Equation 6}$$

where, k for maximizing Equation 6 is used and L means the length of one subframe of a decoder. The gain value of the long-term synthesis filter is obtained by applying the delay value D obtained in Equation 6 to Equation 7.

$$g_p = \frac{\sum_{n=0}^{L-1} u(n)u(n-D)}{\sum_{n=0}^{L-1} u^2(n-D)}, \quad \text{bounded by } 0 \le g_p \le 1.2 \qquad \text{Equation 7}$$

Through the above process, a gain value $g_p$ of an adaptive codebook, D corresponding to a pitch and an adaptive codebook v(n) are finally obtained.

The fixed codebook 330 models a remaining component in which adaptive codebook influence is removed from the excitation signal. The fixed codebook 330 may be searched for by a process of minimizing error between the weighted input signal and the weighted synthesis signal. The target signal of the fixed codebook may be updated to a signal in which the ZSR of the adaptive codebook 320 is removed from the input signal subjected to the weighting filter 300. For example, the target signal of the fixed codebook may be expressed as shown in Equation 8.

$$c(n)=s_w(n)-g_p v(n) \qquad \text{Equation 8}$$

In Equation 8, c(n) denotes the target signal of the fixed codebook, $s_w(n)$ denotes an input signal to which the weighting filter 300 is applied, and $g_p v(n)$ denotes a ZSR of the adaptive codebook 320. v(n) denotes an adaptive codebook generated using a long-term synthesis filter.

The fixed codebook 330 may be searched for by minimizing Equation 9 in a process of minimizing error between the fixed codebook and the target signal of the fixed codebook.

$$Q_k = \frac{(x_{11}^T H c_k)^2}{c_k^T H^T H c_k} = \frac{(d^T c_k)^2}{c_k^T \Phi c_k} = \frac{(R_k)^2}{E_k} \qquad \text{Equation 9}$$

In Equation 9, H denotes a lower triangular Toeplitz convolution matrix generated by an impulse response h(n) of a weighting short-term synthesis filter, a main diagonal component is h(0), and lower diagonals become h(1), . . . , and h(L−1). A numerator of Equation 9 is calculated by Equation 10. $N_p$ is the number of fixed codebooks and $s_i$ denotes an i-th pulse sign.

$$R = \sum_{i=0}^{N_p-1} s_i d(m_i) \qquad \text{Equation 10}$$

A denominator of Equation 9 is calculated by Equation 11.

$$E = \sum_{i=0}^{N_p-1} \varphi(m_i, m_i) + 2\sum_{i=0}^{N_p-1}\sum_{j=i+1}^{N_p-1} s_i s_j \varphi(m_i, m_j) \qquad \text{Equation 11}$$

$$\text{where } \varphi(m_i, m_j) = \sum_{n=m_j}^{N-1} h(n-m_i)h(n-m_j),$$

$$m_i = 0, \ldots, (N-1), m_j = m_i, \ldots, (N-1)$$

The coding parameter of the speech encoder may use a step-by-step estimation method of searching for an optimal adaptive codebook and then searching for a fixed codebook.

FIG. 4 is a diagram showing a process of quantizing an input signal using a quantized immittance spectral frequency candidate vector based on first best information according to an embodiment of the present invention.

Referring to FIG. 4, the linear prediction analyzer 200 may acquire a linear prediction filter coefficient by performing linear prediction analysis with respect to an input signal (S400). The linear prediction filter coefficient may be acquired in a process of minimizing error due to linear prediction and a covariance method, an autocorrelation method, a lattice filter, and a Levinson-Durbin algorithm, etc. may be used, as described above. In addition, the linear prediction filter coefficient may be acquired in frame units.

The quantization unit 210 may acquire a quantized spectrum candidate vector corresponding to the linear prediction filter coefficient (S410). The quantized spectrum candidate vector may be acquired using first best information, which will be described with reference to FIG. 5.

Figure 5:
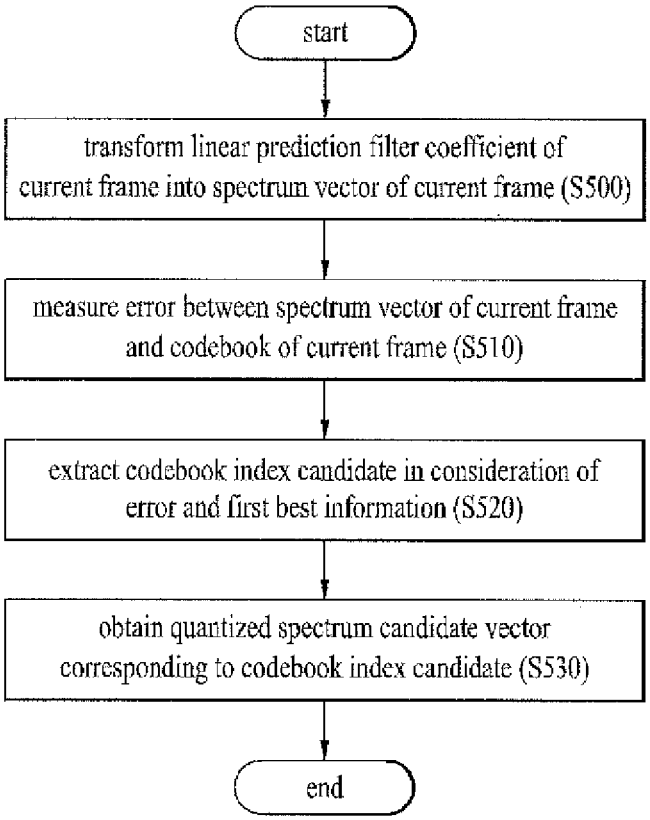
FIG. 5 is a diagram showing a process of acquiring a quantized spectrum candidate vector using first best information.

FIG. 5 is a diagram showing a process of acquiring a quantized spectrum candidate vector using first best information.

Referring to FIG. 5, the quantization unit 210 may transform a linear prediction filter coefficient of a current frame into a spectrum filter of the current frame (S500). The spectrum vector may be an immitance spectral frequency vector. The present invention is not limited thereto and the linear prediction filter coefficient may be converted into a line spectrum frequency or a line spectrum pair.

In a process of mapping the spectrum vector of the current frame to a codebook of the current frame and performing quantization, the spectrum vector may be divided into a number of subvectors and codebooks corresponding to the subvectors may be found. Although a multi-stage vector quantizer having multiple stages may be used, the present invention is not limited thereto.

The spectrum vector of the current frame transformed for quantization may be used without change. Alternatively, a method of quantizing a residual spectrum vector of the current frame may be used. The residual spectrum vector of the current frame may be generated using the spectrum vector of the current frame and a prediction vector of the current frame. The prediction vector of the current frame may be induced from a quantized spectrum vector of a previous frame. For example, the residual spectrum vector of the current frame may be induced as shown in Equation 12.

$$r(n)=z(n)-p(n),\ \text{where}\ p(n)=\tfrac{1}{3}\hat{r}(n-1) \qquad \text{Equation 12}$$

In Equation 12, r(n) denotes the residual spectrum vector of the current frame, z(n) denotes a vector in which an average value of each order is removed from the spectrum vector of the current frame, p(n) denotes the prediction vector of the current frame, and $\hat{r}(n-1)$ denotes the quantized spectrum vector of the previous frame.

The quantization unit 210 may calculate error between the spectrum vector of the current frame and a codebook of the current frame (S520). The codebook of the current frame means a codebook used for spectrum vector quantization. The codebook of the current frame may include quantized code vectors and codebook indexes corresponding to the quantized code vectors. The quantization unit 210 may calculate error between the spectrum vector and the codebook of the current frame and align the quantized code vectors or codebook indexes in ascending order of error.

Codebook indexes may be extracted in light of the error and the first best information of S520 (S530). The first best information may mean information about the number of codebook indexes extracted in frame units. The first best information may be a value predetermined by an encoder. Codebook indexes (or quantized code vectors) may be extracted in ascending order of error between the spectrum vector and the codebook of the current frame according to the first best information.

The quantized spectrum candidate vectors corresponding to the extracted codebook indexes may be acquired (S540). That is, the quantized code vectors corresponding to the extracted codebook indexes may be used as the quantized spectrum candidate vector of the current frame. Accordingly, the first best information may indicate information about the number of quantized spectrum candidate vectors acquired in frame units. One quantized spectrum candidate vector or a plurality of quantized spectrum candidate vectors may be acquired according to the first best information.

The quantized spectrum candidate vector of the current frame acquired in S410 may be used as a quantized spectrum candidate vector for any subframe within the current frame. In this case, the quantization unit 210 may interpolate the quantized spectrum candidate vector (S420). The quantized spectrum candidate vectors for the remaining subframes within the current frame may be acquired through interpolation. Hereinafter, the quantized spectrum candidate vectors acquired on a per subframe basis within the current frame is referred to as a quantized spectrum candidate vector set. In this case, the first best information may indicate information about the number of quantized spectrum candidate vector sets acquired in frame units. Accordingly, one or a plurality of quantized spectrum candidate vector sets may be acquired with respect to the current frame according to the first best information.

For example, the quantized spectrum candidate vector of the current frame acquired in S410 may be used as a quantized spectrum candidate vector of a subframe in which a center of gravity of a window is located. In this case, the quantized spectrum candidate vectors for the remaining subframes may be acquired through linear interpolation between the quantized spectrum candidate vector of the current frame extracted in S410 and the quantized spectrum vector of the previous frame. If the current frame includes four subframes, the quantized spectrum candidate vectors corresponding to the subframes may be generated as shown in Equation 13.

$$q^{[0]}=0.75q_{end,p}+0.25q_{end}$$

$$q^{[1]}=0.5q_{end,p}+0.5q_{end}$$

$$q^{[2]}=0.25q_{end,p}+0.75q_{end}$$

$$q_{[3]}=q_{end} \qquad \text{Equation 13}$$

In Equation 13, $q_{end,p}$ denotes the quantized spectrum vector corresponding to the last subframe of the previous frame and $q_{end}$ denotes the quantized spectrum candidate vector corresponding to the last subframe of the current frame.

The quantization unit 210 acquires a linear prediction filter coefficient corresponding to the interpolated quantized spectrum candidate vector. The interpolated quantized spectrum candidate vector may be transformed onto a linear prediction domain, which may be used to calculate a linear prediction filter and a weighting filter for each subframe.

The psychological weighting filter 280 may generate a weighted input signal from the input signal (S430). The weighting filter may be generated from Equation 3 using the linear prediction filter coefficient acquired from the interpolated quantized spectrum candidate vector.

The adaptive codebook 230 may acquire an adaptive codebook with respect to the weighted input signal (S440). The adaptive codebook may be obtained by the long-term synthesis filter. The long-term synthesis filter may use an optimal delay value and gain value of minimizing error between the target signal of the adaptive codebook and the signal passing through the long-term synthesis filter. The delay value and gain value, that is, the coding parameters of the adaptive codebook, may be extracted with respect to the quantized spectrum candidate vector according to the first best information. The delay value and gain value are shown in Equations 6 and 7. In addition, the fixed codebook 240 searches for the fixed codebook with respect to the target signal of the codebook (S450). The target signal of the fixed codebook and the process of searching for the fixed codebook are shown in Equations 8 and 9, respectively. Similarly, the fixed codebook may be acquired with respect to the quantized immitance spectrum frequency candidate vector or the quantized immitance spectrum frequency candidate vector set according to the first best information.

The adder 250 multiplies the adaptive codebook acquired in S450 and the fixed codebook searched in S460 by respective gain values and adds the codebooks so as to generate an excitation signal (S460). The synthesis filter 260 may perform synthesis filtering by a linear prediction filter coefficient acquired from the interpolated quantized spectrum candidate vector with respect to the excitation signal output from the adder 250 so as to generate a synthesis signal (S470). If a weighting filter is applied to the synthesis filter 260, a weighted synthesis signal may be generated. An error minimization unit 290 may acquire a coding parameter for minimizing error between the input signal (or the weighted input signal) and the synthesis signal (or the weighted synthesis signal) (S480). The coding parameter may include a linear prediction filter coefficient, a delay value and gain value of an adaptive codebook and an index and gain value of a fixed codebook. For example, the coding parameter for minimizing error may be acquired using Equation 14.

$$K_i = \underset{i}{\operatorname{argmin}}\left(s_w(n) - \hat{s}_w^{(i)}(n)\right)^2 \qquad \text{Equation 14}$$

In Equation 14, $s_w$ (n) denotes the weighted input signal and $\hat{s}_w^{(i)}$ (n) denotes the weighted synthesis signal according to an i-th coding parameter.

Figure 6:
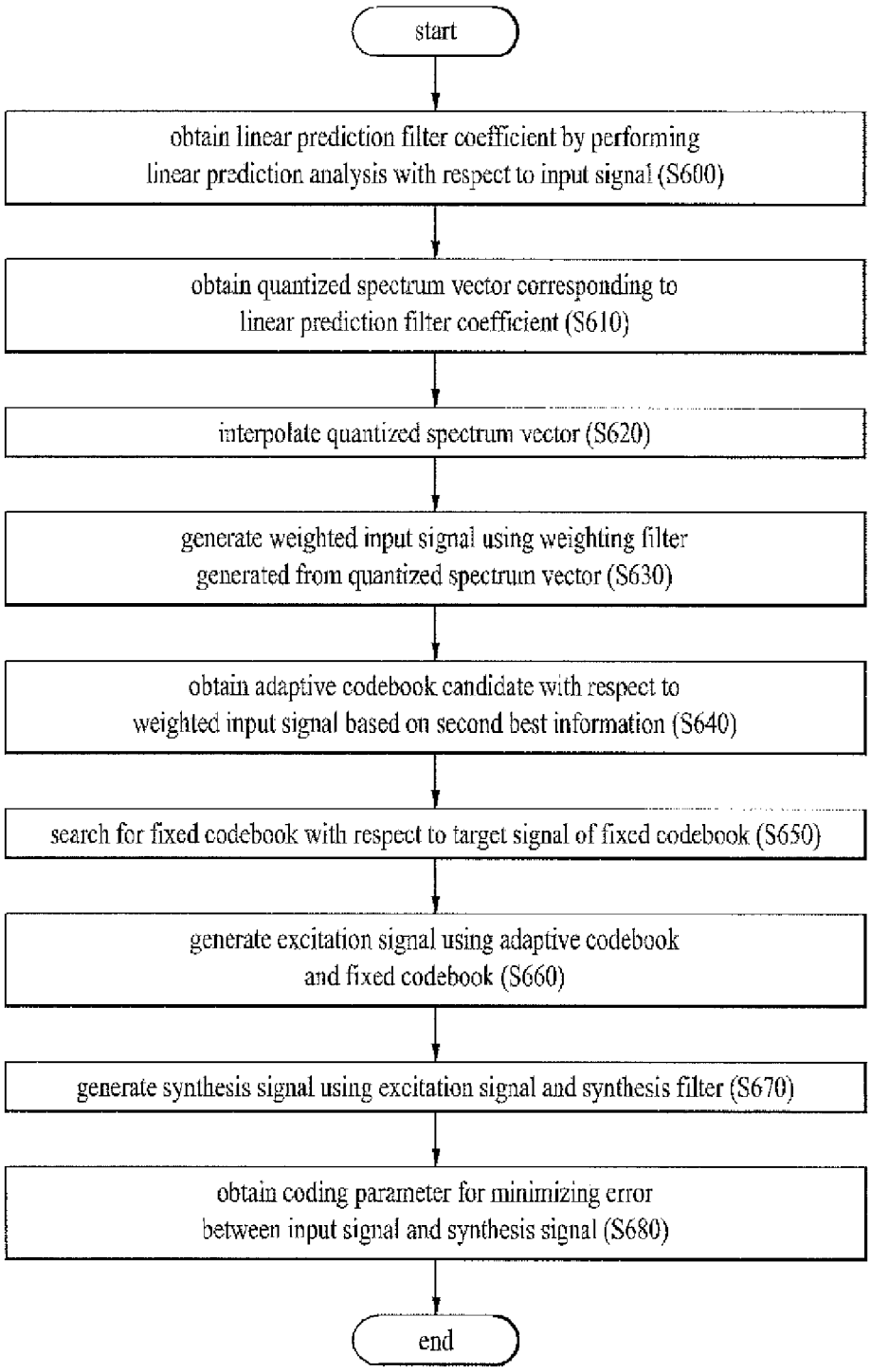
FIG. 6 is a diagram showing a process of quantizing an input signal using an adaptive codebook candidate based on second best information according to an embodiment of the present invention.

FIG. 6 is a diagram showing a process of quantizing an input signal using an adaptive codebook candidate based on second best information according to an embodiment of the present invention.

Referring to FIG. 6, the linear prediction analyzer 200 may acquire a linear prediction filter coefficient by performing linear prediction analysis with respect to an input signal (S600). The linear prediction filter coefficient may be acquired in a process of minimizing error due to linear prediction. A covariance method, an autocorrelation method, a lattice filter, a Levinson-Durbin algorithm, etc. may be used, as described above. In addition, the linear prediction filter coefficient may be acquired in frame units.

The quantization unit 210 may acquire a quantized immitance spectral frequency vector corresponding to the linear prediction filter coefficient (S610). Hereinafter, a method of acquiring the quantized spectrum vector will be described.

The quantization unit 210 may transform a linear prediction filter coefficient of a current frame into a spectrum vector of the current frame in order to quantize the linear prediction filter coefficient on a spectrum frequency domain. This transformation process is described with reference to FIG. 5 and thus a description thereof will be omitted.

The quantization unit 210 may measure error between the spectrum vector of the current frame and the codebook of the current frame. The codebook of the current frame may mean a codebook used for spectrum vector quantization. The codebook of the current frame includes quantized code vectors and indexes allocated to the quantized code vectors. The quantization unit 210 may measure error between the spectrum vector and codebook of the current frame, align the quantized code vectors or the codebook indexes in ascending order of error, and store the quantized code vectors or the codebook indexes.

The codebook index (or the quantized code vector) for minimizing error between the spectrum vector and the codebook of the current frame may be extracted. The quantized code vector corresponding to the codebook index may be used as the quantized spectrum vector of the current frame.

The quantized spectrum vector of the current frame may be used as a quantized spectrum vector for any subframe within the current frame. In this case, the quantization unit 210 may interpolate the quantized spectrum vector (S620). Interpolation is described with reference to FIG. 4 and thus a description thereof will be described. The quantization unit 210 may acquire a linear prediction filter coefficient corresponding to the interpolated quantized spectrum vector. The interpolated quantized spectrum vector may be transformed onto a linear prediction domain, which may be used to calculate a linear prediction filter and a weighting filter for each subframe.

The psychological weighting filter 280 may generate a weighted input signal from the input signal (S630). The weighting filter may be expressed by Equation 3 using the linear prediction filter coefficient from the interpolated quantized spectrum vector.

The adaptive codebook 230 may acquire an adaptive codebook candidate in light of the second best information with respect to the weighted input signal (S640). The second best information may be information about the number of adaptive codebooks acquired in frame units. Alternatively, the second best information may indicate indication about the number of coding parameters of the adaptive codebook acquired in frame units. The code parameter of the adaptive codebook may include a delay value and gain value of the adaptive codebook. The adaptive codebook candidate may indicate an adaptive codebook acquired according to the second best information.

First, the adaptive codebook 230 may acquire a delay value and a gain value corresponding to error between a target signal of an adaptive codebook and a signal passing through a long-term synthesis filter. The delay value and the gain value may be aligned in ascending order of error and may be then stored. The delay value and the gain value may be extracted in ascending order of error between the target signal of the adaptive codebook and the signal passing through the long-term synthesis filter. The extracted delay value and gain value may be used as the delay value and gain value of the adaptive codebook candidate.

The long-term synthesis filter candidate may be obtained using the extracted delay value and gain value. By applying the long-term synthesis filter candidate to the input signal or the weighted input signal, the adaptive codebook candidate may be acquired.

The fixed codebook 240 may search for a fixed codebook with respect to a target signal of a fixed codebook (S650). The target signal of the fixed codebook and the process of searching the fixed codebook are shown in Equations 8 and 9, respectively. The target signal of the fixed codebook may indicate a signal in which a ZSR of an adaptive codebook candidate is removed from the input signal subjected to the weighting filter 300. Accordingly, the fixed codebook may be searched for with respect to the adaptive codebook candidate according to the second best information.

The adder 250 multiplies the adaptive codebook acquired in S640 and the fixed codebook searched in S650 by respective gain values and adds the codebooks so as to generate an excitation signal (S660). The synthesis filter 260 may perform synthesis filtering by a linear prediction filter coefficient acquired from the interpolated quantized spectrum candidate vector with respect to the excitation signal output from the adder 250 so as to generate a synthesis signal (S670). If a weighting filter is applied to the synthesis filter 260, a weighted synthesis signal may be generated. The error minimization unit 290 may acquire a coding parameter for minimizing error between the input signal (or the weighted input signal) and the synthesis signal (or the weighted synthesis signal) (S680). The coding parameter may include a linear prediction filter coefficient, a delay value and gain value of an adaptive codebook and an index and gain value of a fixed codebook. For example, the coding parameter for minimizing error is shown in Equation 14 and thus a description thereof will be omitted.

Figure 7:
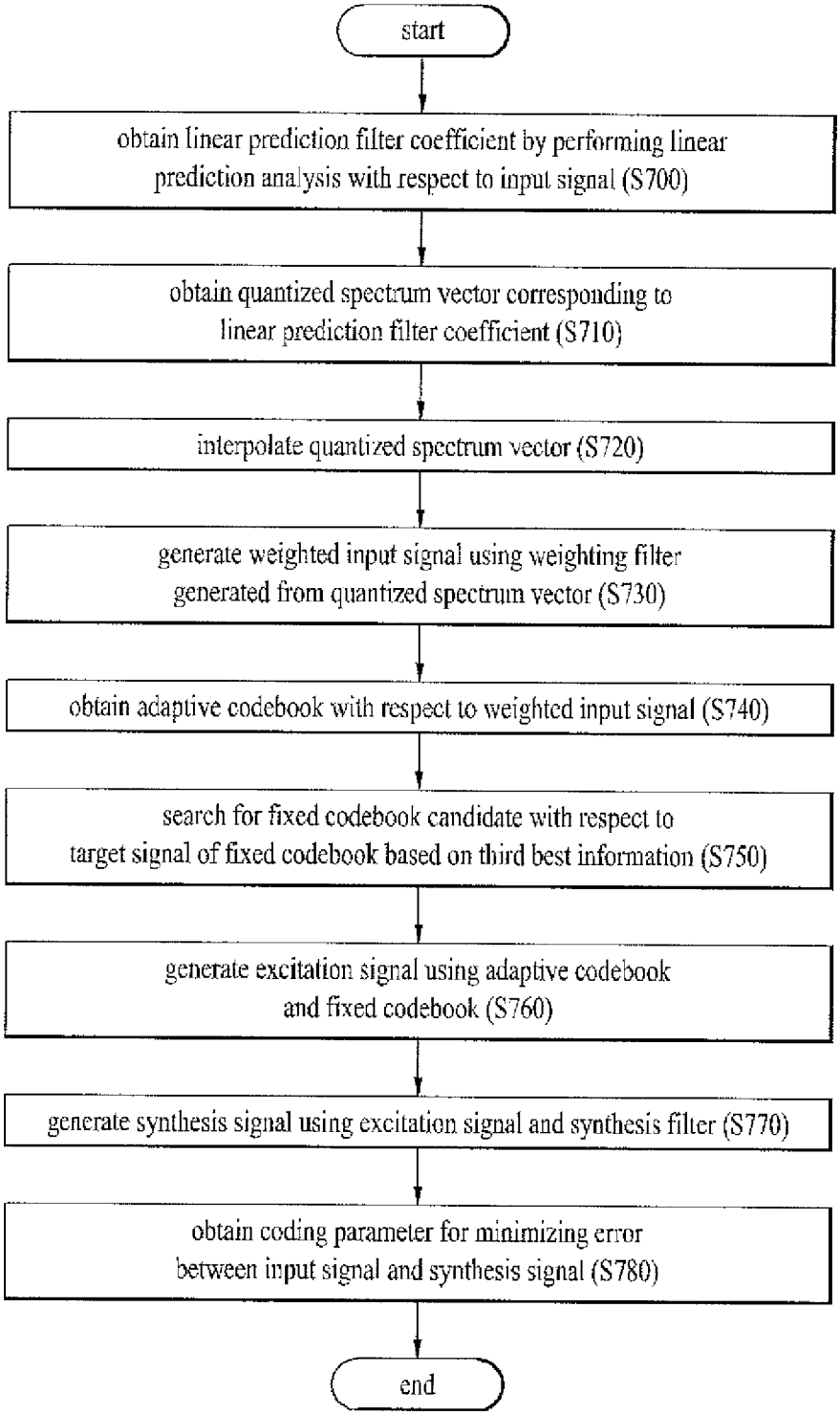
FIG. 7 is a diagram showing a process of quantizing an input signal using an adaptive codebook candidate based on third best information according to an embodiment of the present invention.

FIG. 7 is a diagram showing a process of quantizing an input signal using an adaptive codebook candidate based on third best information according to an embodiment of the present invention.

Referring to FIG. 7, the linear prediction analyzer 200 may acquire a linear prediction filter coefficient by performing linear prediction analysis with respect to an input signal in frame units (S700). The linear prediction filter coefficient may be acquired in a process of minimizing error due to linear prediction.

The quantization unit 210 may acquire a quantized spectrum vector corresponding to the linear prediction filter coefficient (S710). The method of acquiring the quantized spectrum vector is described with reference to FIG. 4 and thus a description thereof will be omitted.

The quantized spectrum vector of the current frame may be used as a quantized immitance spectrum frequency vector for any one of subframes within the current frame. In this case, the quantization unit 210 may interpolate the quantized spectrum vector (S720). The quantized immitance spectrum frequency vectors for the remaining subframes within the current frame may be acquired through interpolation. The interpolation method is described with reference to FIG. 4 and thus a description thereof will be given.

The quantization unit 210 may acquire a linear prediction filter coefficient corresponding to the interpolated quantized spectrum vector. The interpolated quantized spectrum vector may be transformed onto a linear prediction domain, which may be used to calculate a linear prediction filter and a weighting filter for each subframe.

The psychological weighting filter 280 may generate a weighted input signal from the input signal (S730). The weighting filter may be expressed by Equation 3 using the linear prediction filter coefficient from the interpolated quantized spectrum vector.

The adaptive codebook 230 may acquire an adaptive codebook with respect to the weighted input signal (S740). The adaptive codebook may be obtained by a long-term synthesis filter. The long-term synthesis filter may use an optimal delay value and gain value for minimizing error between a target signal of the adaptive codebook and a signal passing through the long-term synthesis filter. The method of acquiring the delay value and the gain value is described with reference to Equations 6 and 7.

The fixed codebook 240 may search for a fixed codebook candidate with respect to the target signal of the fixed codebook based on third best information (S750). The third best information may indicate information about the number of coding parameters of the fixed codebook extracted in frame units. The coding parameter of the fixed codebook may include an index and gain value of the fixed codebook. The target signal of the fixed codebook is shown in Equation 8.

The fixed codebook 330 may calculate error between the target signal of the fixed codebook and the fixed codebook. The index and gain value of the fixed codebook may be aligned and stored in ascending order of error between the target signal of the fixed codebook and the fixed codebook.

The index and gain value of the fixed codebook may be extracted in ascending order of error between the target signal of the fixed codebook and the fixed codebook according to the third best information. The extracted index and gain value of the fixed codebook may be used as the index and gain value of the fixed codebook candidate.

The adder 250 multiplies the adaptive codebook acquired in S740 and the fixed codebook candidate searched in S750 by respective gain values and adds the codebooks so as to generate an excitation signal (S760). The synthesis filter 260 may perform synthesis filtering by a linear prediction filter coefficient acquired from the interpolated quantized spectrum candidate vector with respect to the excitation signal output from the adder 250 so as to generate a synthesis signal (S770). If a weighting filter is applied to the synthesis filter 260, a weighted synthesis signal may be generated. The error minimization unit 290 may acquire a coding parameter for minimizing error between the input signal (or the weighted input signal) and the synthesis signal (or the weighted synthesis signal) (S780). The coding parameter may include a linear prediction filter coefficient, a delay value and gain value of an adaptive codebook and an index and gain value of a fixed codebook. For example, the coding parameter for minimizing error is shown in Equation 14 and thus a description thereof will be omitted.

In addition, the input signal may be quantized by a combination of the first best information, the second best information and the third best information.

INDUSTRIAL APPLICABILITY

The present invention may be used for speech signal encoding.

The invention claimed is:

1. A method of encoding a speech signal, the method comprising:

obtaining, with a speech encoding apparatus, a linear prediction filter coefficient of a current frame from an input signal using linear prediction;

obtaining, with the speech encoding apparatus, a quantized spectrum candidate vector of the current frame corresponding to the linear prediction filter coefficient of the current frame based on first best information;

interpolating, with the speech encoding apparatus, the quantized spectrum candidate vector of the current frame and a quantized spectrum vector of a previous frame;

generating, with the speech encoding apparatus, weighted input signal using the quantized spectrum candidate vector; and obtaining, with the speech encoding apparatus, adaptive codebook candidate based on the weighted input signal and second best information, wherein the first best information is information about a number of codebook indexes extracted in frame units, wherein the second best information is information about a number of the adaptive codebook candidate acquired in frame units.

2. The method of claim 1, wherein the obtaining the quantized spectrum candidate vector includes:

transforming, with the speech encoding apparatus, the linear prediction filter coefficient of the current frame into a spectrum vector of the current frame;

calculating, with the speech encoding apparatus, error between the spectrum vector of the current frame and a codebook of the current frame; and extracting, with the speech encoding apparatus, codebook indexes of the current frame in consideration of the error and the first best information, wherein the codebook of the current frame includes quantized code vectors and codebook indexes corresponding to the quantized code vectors.

3. The method of claim 2, further comprising calculating, with the speech encoding apparatus, error between the spectrum vector and codebook of the current frame and aligning the quantized code vectors or the codebook indexes in ascending order of error.

4. The method of claim 3, wherein the codebook indexes of the current frame are extracted in ascending order of error between the spectrum vector and codebook of the current frame.

5. The method of claim 2, wherein the quantized code vectors corresponding to the codebook indexes are quantized immitance spectrum frequency candidate vectors of the current frame.

6. An apparatus for encoding a speech signal, the apparatus comprising:

a linear prediction analyzer configured to acquire a linear prediction filter coefficient of a current frame from an input signal using linear prediction;

a quantization unit configured to acquire a quantized spectrum candidate vector of the current frame corresponding to the linear prediction filter coefficient of the current frame based on first best information and to interpolate the quantized spectrum candidate vector of the current frame and a quantized spectrum vector of a previous frame, a psychological weighting filter generating weighted input signal using the quantized spectrum candidate vector; and an adaptive codebook obtaining adaptive codebook candidate based on the weighted input signal and second best information, wherein the first best information is information about a number of codebook indexes extracted in frame units, wherein the second best information is information indicating a number of the adaptive codebook candidate acquired in frame units.

7. The apparatus of claim 6, wherein the quantization unit configured to acquire the quantized spectrum frequency candidate vector transforms the linear prediction filter coefficient of the current frame into a spectrum vector of the current frame, measures error between the spectrum vector of the current frame and a codebook of the current frame, and extracts codebook indexes in consideration of the error and the first best information, wherein the codebook of the current frame includes quantized code vectors and codebook indexes corresponding to the quantized code vectors.

8. The apparatus of claim 7, wherein the quantization unit calculates error between the spectrum vector and codebook of the current frame and aligns the quantized code vectors or the codebook indexes in ascending order of error.

9. The apparatus of claim 8, wherein the codebook indexes of the current frame are extracted in ascending order of error between the spectrum vector and codebook of the current frame.

10. The apparatus of claim 7, wherein the quantized code vectors corresponding to the codebook indexes are quantized immitance spectrum frequency candidate vectors of the current frame.

* * * * *